US009265689B2

(12) United States Patent
Stanbridge

(10) Patent No.: US 9,265,689 B2
(45) Date of Patent: Feb. 23, 2016

(54) THERAPEUTIC DEVICE AND METHOD FOR SCAR TISSUE THERAPY HAVING INTERMEDIATE AND OPPOSED HEADS

(76) Inventor: Stanley R. Stanbridge, Costa Mesa, CA (US)

( * ) Notice: Subject to any disclaimer, the term of this patent is extended or adjusted under 35 U.S.C. 154(b) by 592 days.

(21) Appl. No.: 13/374,220

(22) Filed: Dec. 16, 2011

(65) Prior Publication Data

US 2012/0253245 A1 Oct. 4, 2012

Related U.S. Application Data

(60) Provisional application No. 61/459,620, filed on Dec. 16, 2010, provisional application No. 61/520,347, filed on Jun. 7, 2011.

(51) Int. Cl.
*A61H 23/00* (2006.01)
*A61H 23/02* (2006.01)

(52) U.S. Cl.
CPC ..... *A61H 23/008* (2013.01); *A61H 23/006* (2013.01); *A61H 23/0218* (2013.01); *A61H 23/0254* (2013.01); *A61H 2201/0153* (2013.01); *A61H 2201/0157* (2013.01); *A61H 2201/0165* (2013.01); *A61H 2201/0169* (2013.01); *A61H 2201/1215* (2013.01); *A61H 2201/149* (2013.01); *A61H 2201/1436* (2013.01)

(58) Field of Classification Search
CPC ... A61H 23/00; A61H 23/006; A61H 23/008; A61H 23/0218; A61H 23/0254; A61H 1/008
USPC ..... 601/2, 23, 27, 30–32, 46, 49–51, 53, 601/56–59, 61, 62, 66, 78–81, 84, 85, 87, 601/89, 92, 93, 97, 101, 103, 104, 107, 108, 601/111, 134–137, 139, 237; 128/62
See application file for complete search history.

(56) References Cited

U.S. PATENT DOCUMENTS

| | | | | |
|---|---|---|---|---|
| 1,955,623 | A * | 4/1934 | Donoway | 601/108 |
| 4,513,737 | A * | 4/1985 | Mabuchi | 601/101 |
| 4,604,993 | A * | 8/1986 | Moriwaki et al. | 601/18 |
| 4,742,875 | A * | 5/1988 | Bell | 173/117 |
| 5,413,550 | A * | 5/1995 | Castel | 601/2 |
| 5,803,916 | A * | 9/1998 | Kuznets et al. | 601/112 |
| 6,440,091 | B1 * | 8/2002 | Hirosawa | 601/133 |
| 6,500,141 | B1 * | 12/2002 | Irion et al. | 604/22 |
| 6,568,000 | B1 * | 5/2003 | Kaufman et al. | 4/622 |
| 7,435,232 | B2 * | 10/2008 | Liebschner | 600/587 |
| 2001/0027280 | A1 * | 10/2001 | Huang | 601/108 |

(Continued)

OTHER PUBLICATIONS

Author: Lennart D. Johns Title: Nonthermal Effects of Therapeutic Ultrasound: The Frequency Resonance Hypothesis Date: 2002 Publisher: Journal of Athletic Training vol. 2002;37(3):293-299 Pertinent pp. 293, 293.*

(Continued)

*Primary Examiner* — Justine Yu
*Assistant Examiner* — Christopher Miller
(74) *Attorney, Agent, or Firm* — Roy A. Ekstrand

(57) ABSTRACT

A therapeutic device includes a power unit for cyclically moving a therapeutic head unit at a frequency selected to cause compression wave energy to propagate through body tissue to a target scar tissue structure. The therapeutic head unit includes a plurality of differently shaped therapeutic heads to be pressed against the body surface.

3 Claims, 14 Drawing Sheets

(56) References Cited

U.S. PATENT DOCUMENTS

| | | | | |
|---|---|---|---|---|
| 2002/0161315 | A1* | 10/2002 | Harris et al. | 601/84 |
| 2003/0158505 | A1* | 8/2003 | Calvert | 601/110 |
| 2006/0047315 | A1* | 3/2006 | Colloca et al. | 606/239 |
| 2009/0099485 | A1* | 4/2009 | Sarvazyan et al. | 601/2 |
| 2009/0306561 | A1* | 12/2009 | Naganuma | 601/137 |

OTHER PUBLICATIONS

Author: N/A Title: Nogier Frequencies Date: Archived by Wayback Machine on Jan. 30, 2008 Publisher: www.nirtherapy.com Edition: N/A Pertinent pp. 1 Web Address: http://nirtherapy.com/nogier.php.*

* cited by examiner

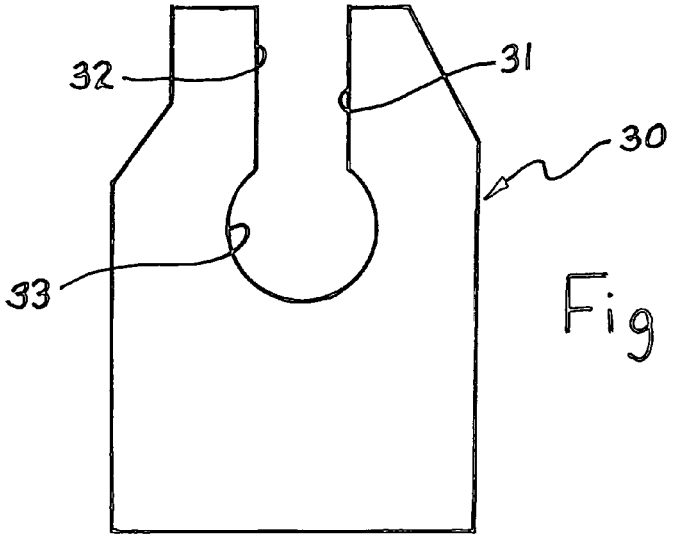
Fig 6
Fig 7
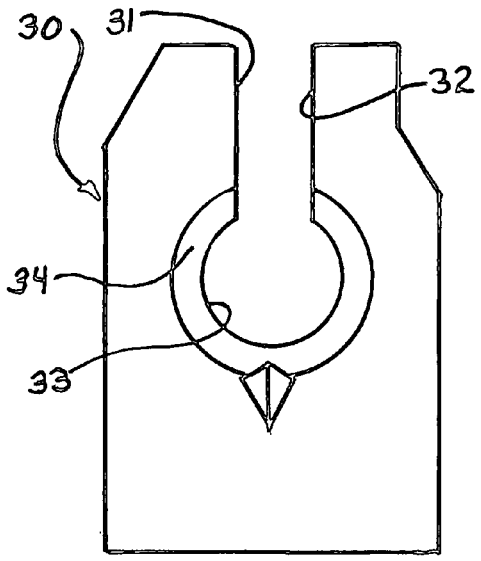
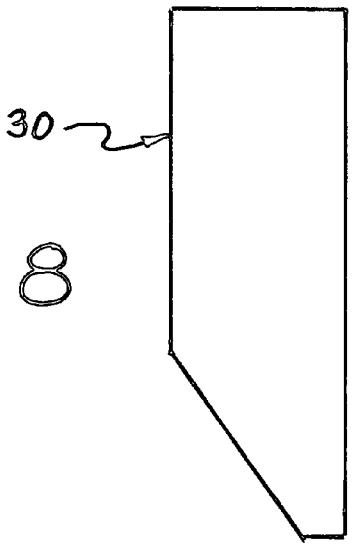
Fig 8

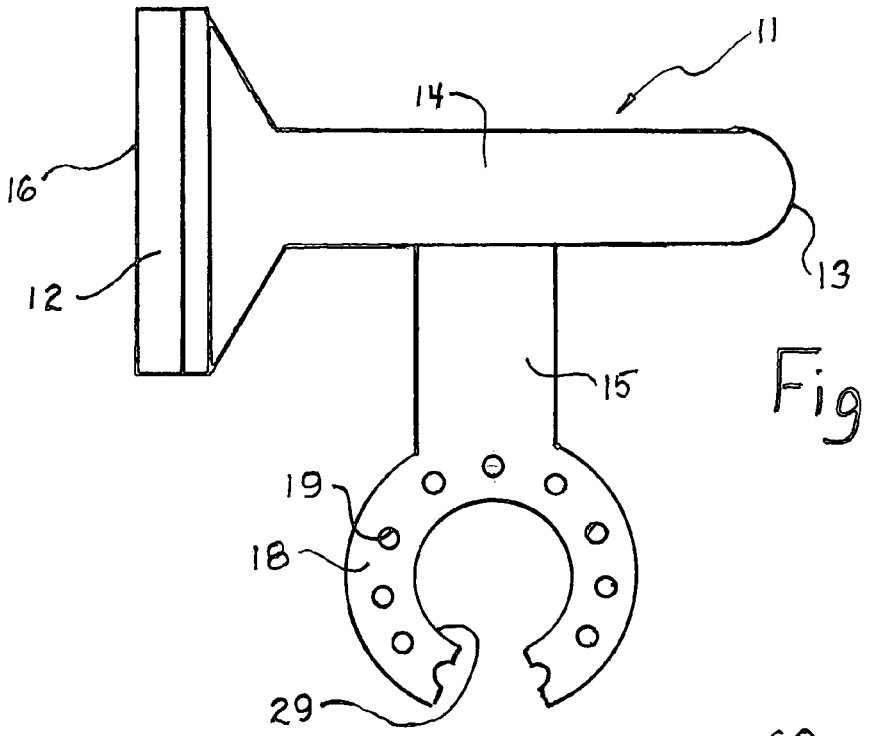
Fig 9
Fig 10
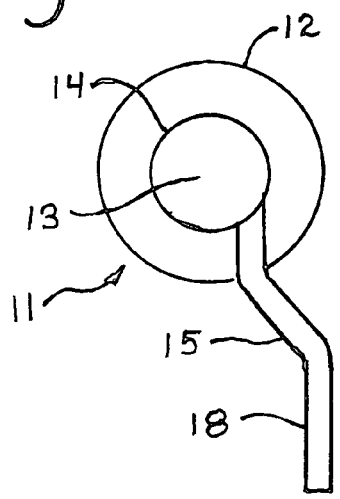
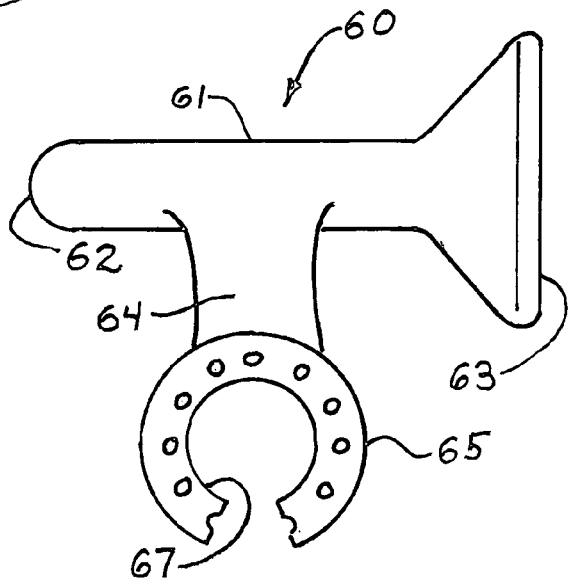
Fig 11

Fig 12
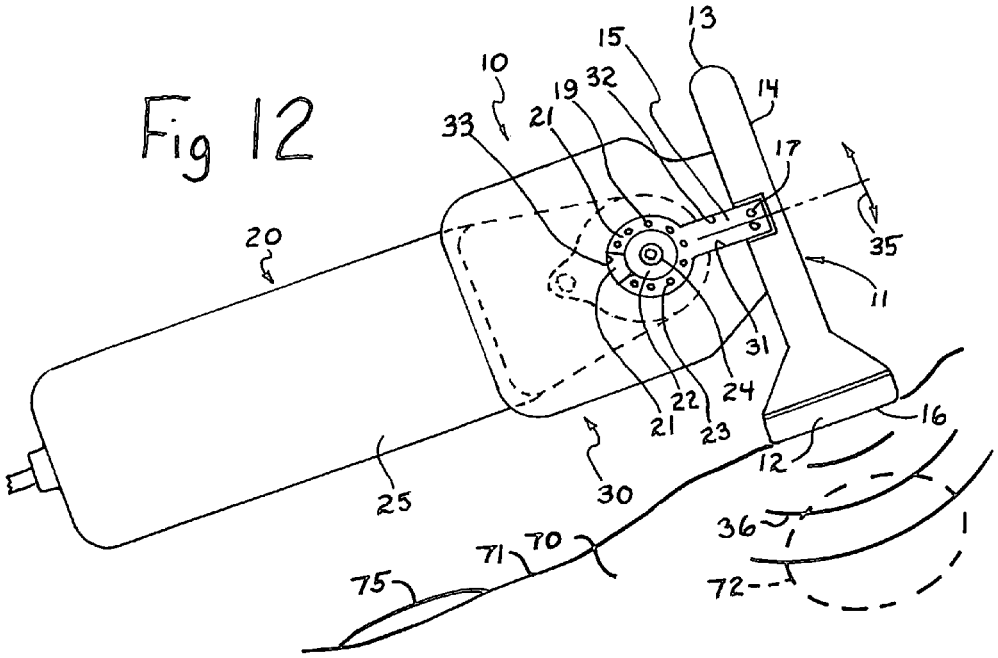
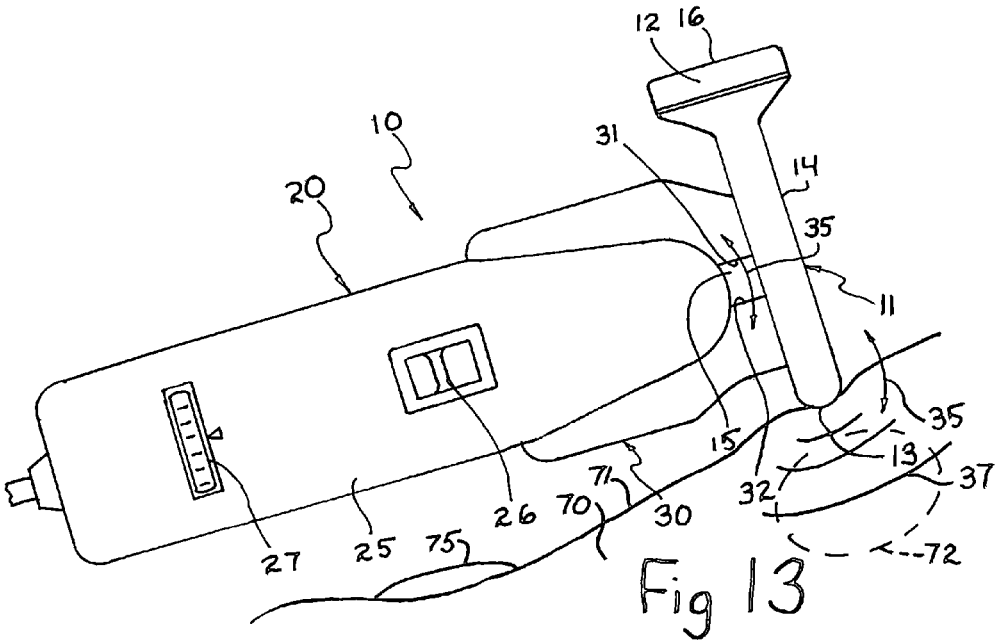
Fig 13

THERAPEUTIC DEVICE AND METHOD FOR SCAR TISSUE THERAPY HAVING INTERMEDIATE AND OPPOSED HEADS

CROSS-REFERENCE TO RELATED APPLICATION

This application claims the benefit of and priority under 35 U.S.C. 119(e) of U.S. Provisional Patent Application No. 61/459,620 entitled THERAPEUTIC DEVICE AND METHOD FOR SCAR TISSUE THERAPY filed Dec. 16, 2010 in the name of Stanley Stanbridge and Provisional Patent Application No. 61/520,347 entitled THERAPEUTIC DEVICE AND METHOD FOR SCAR TISSUE THERAPY HAVING INTERMEDIATE AND OPPOSED HEADS filed Jun. 7, 2011 in the name of Stanley Stanbridge, the disclosure of which are incorporated herein by reference.

FIELD OF THE INVENTION

This invention relates generally to massage therapy and particularly to apparatus and treatment methods for dealing with scar tissue conditions together with various conditions such as tissue inflammation, carpal tunnel syndrome, tendonosis, muscle spasms, trapped nerves, motion range limitations, contractures, neuromas, adhesions, knee problems, tennis elbow, headaches, TMJ, and gout as well as back, shoulder and ankle pain.

BACKGROUND OF THE INVENTION

Within the human body various healing responses to injury, tissue damage, inflammation and other conditions often includes the formation of scar tissue and scar tissue buildup. Generally speaking, scaring takes place as the body develops a network of relatively strong, tough tissues. These tissues often form networks of stronger, tougher fibrous tissues which invade and permeate softer body tissue.

Scar tissue, often referred to as "adhesions" is created as a temporary patching and repair mechanism for wounds caused by injury or surgery. Scar tissue may also form as a result of highly repetitive motions such as throwing a ball or operating a keyboard or other computer input device. The repetitive stress often associated with such activities may cause muscles to tighten up and therein cause friction and inflammation between layers of moving body tissue. When a muscle tightens up, swelling often occurs restricting the oxygen supply to the muscles and connective tissue. Scar tissue or adhesions may be produced by the lack of oxygen together with friction and inflammation from these repetitive type of activities.

One example of such scar tissue formation is generally known as "carpal tunnel" syndrome in which scar tissue and adhesions often form within the body and are primarily resident in the muscles, tendons, ligaments, fascia and joints which interact with and often surround associated nerves and blood vessels.

When an injury occurs, the body responds with a complex sequence of operations. Specialized cells called fibroblasts resident beneath the skin surface initially move into a provisional wound matrix, often referred to as a clot, and start secreting collagen to stabilize the injury as quickly as possible. This wound matrix is initially soft and is heavily loaded with growth factors. The fibroblast move about the matrix pulling and reorganizing the fibers. The matrix then grows stiffer and, at a certain point, the action of the fibroblasts changes into powerful contractal cell action which in turn anchors the cells to the matrix pulling the edges of the wound together. Since there are no blood vessels that nourish this fibrotic tissue, it dries and constricts becoming dead, rigid and inflexible. If the scar tissue and adhesions remain after their usefulness has expired, they often trap and contract around nerves causing pain and impairing movement.

While such scar tissue formation may be an important part of body response to trauma, inflammation and other stresses imposed upon the body, over time scar tissue can become a source of pain and difficulty. All too frequently, scarring can lead to undesired and painful conditions which persist long after the healing response to the original trauma has been completed. Such persistent scarring and the more extensive condition often referred to as "over scarring" may occur from skin surface regions to deep body regions and joint areas.

The pain and other problems associated with residual scar tissue buildup creates a need in the art for ever more improved treatment apparatus and methods of treatment directed toward reducing and removing scar tissue buildup and residual networks of scar tissue.

In addition to scar tissue formation created problems, a variety of other problems and conditions arise in the body such as tissue inflammation, carpal tunnel syndrome, tendonosis, muscle spasms, trapped nerves, motion range limitations, contractures, neuromas, adhesions, knee problems, tennis elbow, headaches, TMJ and gout as well as back, shoulder and ankle pain.

Confronted with the wide variety of injuries, maladies and other condition which cause pain, suffering and limitations of movement within the body, practitioners in the art have endeavored to provide suitable and effective therapeutic devices and methods of treatment. For example, U.S. Pat. No. 4,632,095 issued to Libin sets forth a PRESSURE-POINT ATTACHMENT FOR USE WITH ELECTRICAL HAND-HELD MASSAGERS designed to slip upon the vibrating head of a handheld electrical vibrator. The attachment is used to apply point-pressure combined with vibration to body tissue points that correspond to body organs, nerves and glands as disclosed in the field of reflexology massaging. The attachment is formed of a circular disk having a conical finger extending from the center of the disk.

U.S. Pat. No. 3,841,321 issued to Albach, et al. sets forth a HAND MANIPULATED BODY MASSAGER having an enclosed casing for massage application to the body. The casing includes a cylindrical body wall and hemispherical end wall which is vibrated by a gyratory motor supported therein. The remaining end of the casing is closed by a cover which presents a cylindrical rim attached to the casing together with a tapered nose extension for facial or scalp massage attachments.

U.S. Pat. No. 6,616,621 issued to Kohr sets forth a MASSAGING DEVICE which includes a motor integrated within a housing, a shaft for transmitting motor motion, a treatment head attachable to the shaft and a control circuit for rotational speed control. The set point of the rotational speed of the motor is manually adjustable.

U.S. Pat. No. 7,229,424 issued to Jones, et al. sets forth a HANDHELD MASSAGE DEVICE WITH REMOVABLE HANDLE which provides a modular apparatus allowing the user the option of employing a roller mechanized massager with or without an elongated handle.

U.S. Pat. No. 942,299 issued to Wiking sets forth an MASSAGE DEVICE having an elongated handle supporting a rotating hand crank mechanism. The hand crank mechanism rotates an output shaft which extends from the elongated handle to an end unit which in turn includes a rotational offset weight apparatus providing vibratory energy when the hand crank is driven.

Published U.S. Patent Application U.S. 2002/0161315 filed on behalf of Harris, et al. sets forth a HAND-HELD PERCUSSIVE MASSAGER WITH ADJUSTABLE NODES utilizing a flat vibrating massage head and a pair of percussion massages nodes all of which is driven by a single internal driven unit. The percussion massage nodes are adjustable for width and are manually controlled by the flat massage head on the opposite side thereof.

A large number of different aesthetic designs for massage units have been provided by practitioners in the art in attempting to increase the attractiveness and usefulness of such handheld massagers. By way of example, Design U.S. Pat. D467,347S issued to Yang; Design U.S. Pat. D435,913S issued to Harris, et al.; Design U.S. Pat. D470,239S issued to Yang; Design U.S. Pat. D609,817S issued to Piller, et al. and Design Patent Des. 430,938 issued to Lee are illustrative of different aesthetic designs provided for handheld massage units.

In a related art, U.S. Pat. No. 7,320,691 issued to Pilcher, et al. sets forth an APPARATUS AND METHOD FOR ACOUSTIC/MECHANICAL TREATMENT OF EARLY STAGE ACNE includes at least two skin contacting elements, the elements having narrow end faces and a mounting assembly for holding the elements closely adjacent to one another. A driving mechanism reciprocally moves one element relative to the adjacent elements at a frequency which provides action upon the skin pores to loosen sebaceous plugs present in the skin pores permitting removal from the skin.

U.S. Pat. No. 3,526,219 issued to Balamuth sets forth a METHOD AND APPARATUS FOR ULTRASONICALLY REMOVING TISSUE FROM A BIOLOGICAL ORGANISM while U.S. Pat. No. 2,984,241 issued to Carlson and U.S. Pat. No. 4,832,683 issued to Idemoto, et al. sets forth a SURGICAL INSTRUMENT each illustrative of different handheld powered apparatus applied to tissue.

In a related art, a large size therapeutic device manufactured and distributed by Sonorex Corporation under the tradename Sonocour Orthopedic Extracorporeal Shockwave System provides an extra corporeal shockwave therapy device in which a shockwave is generated at the base of a shock tube by an electromagnetic acoustic source. The shockwave source includes a water-filled generator and an acoustic lens. The latter is operative to focus and direct the acoustic energy generated within the electromagnetic acoustic source.

While the foregoing described prior art devices have to some extent improved the art and in some instances enjoyed commercial success, there remains nonetheless a continuing and unresolved need in the art for handheld therapeutic apparatus which is effective in treating resistant and troublesome painful tissue such as scar tissue and the like through the use of effective energy waves introduced to the body tissue at a desired amplitude and frequency which is optimized for the tissue malady.

SUMMARY OF THE INVENTION

The present invention provides an apparatus and method for effectively treating scar tissue within softer body tissue. The invention utilizes a novel massage apparatus having a reciprocating angular drive mechanism which is preferably handheld and which provides reciprocating arcuate power at an output coupling. The apparatus further includes a therapeutic device head having a generally T-shaped member which engages the output drive of the power source at the body portion of the T-center. The therapeutic device head further includes an elongated dual therapeutic device head which defines a generally larger planar massage surface and an opposed generally spherical smaller diameter portion. The therapeutic device head further includes a transversely positioned support flange upon which an intermediate head is supported. The intermediate massage head provides an alternative massage element for application to the skin and body of the patient. The head is oscillated through an arcuate movement at a predetermined frequency which has been found to be extremely effective in scar tissue treatment. In accordance with the present invention method of treatment, the massage device is activated oscillating the therapeutic device head and the head is then positioned against the outer surface of the body area of interest. The arcuate oscillation at the selected frequency causes the therapeutic device head to impart the shock waves to the body tissue in the region of contact which permeate into the body. The selected frequency of oscillation of the therapeutic device head produces shockwaves at a frequency which breaks up scar tissue.

While the present invention therapeutic apparatus has been found to be extremely effective in treating scar tissue structures within the human body, it has also been found effective against a variety of therapeutic procedures and situation such as those referred to above. In such case, the massager stroke and frequency of energy imparted to the body is adjusted to suit the tissue structures being treated and to maximize the therapeutic effect.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 6 sets forth a front view of the vibration damping element of the present invention therapeutic device;

FIG. 7 sets forth a rear view of the vibration damping element of the present invention therapeutic device;

FIG. 8 sets forth a side elevation view of the vibration damping element of the present invention therapeutic device;

FIG. 9 sets forth a rear view of the therapeutic device head of the present invention therapeutic device;

FIG. 10 sets forth a side view of the therapeutic device head of the present invention therapeutic device;

FIG. 11 sets forth a front view of an alternate embodiment therapeutic device head of the present invention therapeutic device;

FIG. 12 sets forth the present invention therapeutic device applied to body tissue in accordance with the present invention method;

FIG. 13 sets forth an alternate view of the present invention therapeutic device applied to body tissue in accordance with the present invention;

DESCRIPTION OF THE PREFERRED EMBODIMENTS

Figure 1:
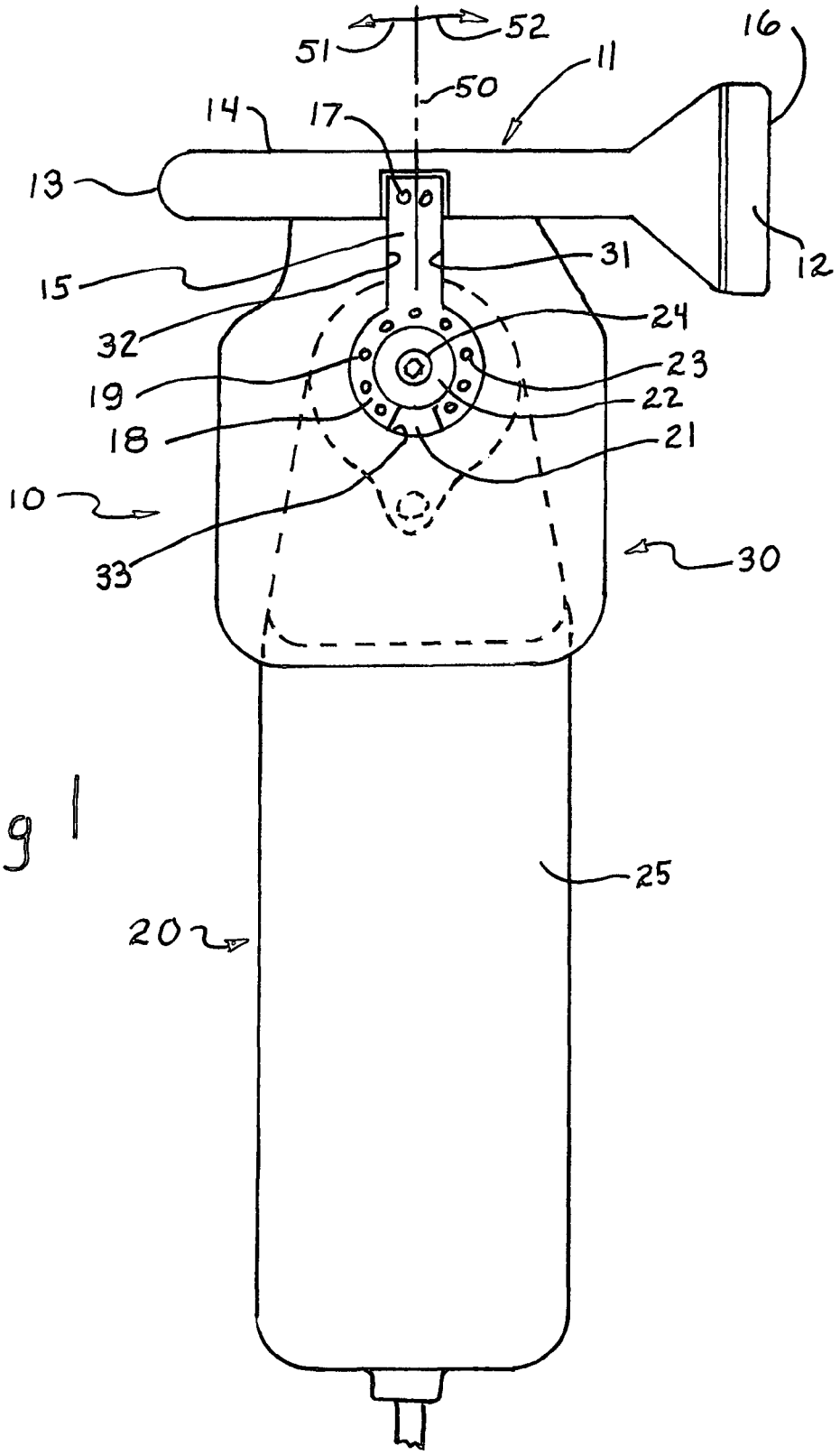
FIG. 1 sets forth a front view of a therapeutic device constructed in accordance with the present invention.

By way of overview, the present invention provides a novel tissue massage and method of tissue therapy which combine to effectively treat and for the most part remove troublesome scar tissue networks within softer body tissue. The therapeutic device utilizes a power unit which provides arcuate oscillatory motion of an output shaft of the type typically used for handheld detail work saw apparatus. The therapeutic device further utilizes a novel therapeutic device head defining a center member which is operatively coupled to the power unit output shaft and which further includes a pair of opposed therapeutic device heads. In the preferred fabrication of the invention, the opposed heads of the therapeutic device head include a generally planar larger diameter therapeutic device head and a smaller diameter generally spherically shaped massaged head. In accordance with the inventive method, the power unit is energized causing the therapeutic device head to rapidly oscillate through a range of arcuate motions at a frequency selected in accordance with the present invention. The frequency of oscillation is precisely selected to provide the desired frequency of shockwaves within the body. The inventive method further includes applying a selected one of the therapeutic device heads the body surface proximate the area of treatment and causing the therapeutic device head to impart shockwaves to the underlying body tissue at the selected frequency. The shockwaves imparted to the body tissue breaks up the undesired scar tissue without damaging surrounding soft tissue.

By way of further overview, the present invention therapeutic device and method will be understood to generate mechanical compression waves having frequencies generally near the middle of the audio range of human beings (100 Hz to 200 Hz). For most structures 165 Hz. In essence, this energy is a pressure disturbance within the tissue that moves in the form of compression waves disturbing tissue particles from their rest position. The energy of the wave is transferred through the tissue as the sequence of tissue particles are moved from their equilibrium positions and thereby exert successive forces upon adjacent tissue elements.

Scar tissue differs from the normal surrounding tissue within the body in that it behaves more as a solid and when exposed to compression wave energy the transverse wave portions of the compression waves produce a sheer force within the scar tissue acting generally perpendicular to the direction of compression wave propagation. This sheer force releases energy into the more rigid and brittle scar tissue while passing easily through healthy supple tissue.

In accordance with the present invention, the application of mechanical wave energy from a moving head directly onto the skin transfers the maximum portion of the wave energy into the tissue through the skin barrier. Generally, the energy of compression waves traveling through normal healthy human tissue move easily and very little energy is absorbed by the tissues. In contrast, the more rigid tissue typical of scar tissue and associated tissue structures tend to absorb a substantial portion of the incident wave energy.

The well known phenomenon of structural resonance describes the circumstance by which virtually all structures including body scar tissue tend to exhibit a resonant or natural frequency. One important characteristic of this resonant or natural frequency is the "reinforcing response" which occurs when structures are subjected to wave energy at their resonant or natural frequency. This phenomenon is well known in mechanical structures such as buildings, bridges, etc. and is characterized by a rapid increase in the vibratory response at the resonant frequency which may, if unchecked, prove to be destructive. Correspondingly, the application of compression waves at the resonant or natural frequencies of the scar tissue structures produces greatly increased vibratory response which causes the scar tissue structure to be broken up and generally dissolved by the body. Since the surrounding normal healthy tissues of the body do not have the same rigidity and resonant frequency characteristic as the scar tissue, the normal healthy tissues are virtually unaffected by the compression wave energy.

Thus in accordance with an important aspect of the present invention therapeutic device and method, the frequency of compression wave energy introduced in the body by the movement of the device therapeutic head is selected to correspond to the resonant or natural frequency of the scar tissue structure under treatment. Accordingly, the frequency at which the therapeutic head moves in association with the skin surface of the body during therapy is carefully selected to correspond to the resonant or natural frequency of the scar tissue structure being targeted by the therapy which is within (100 Hz-200 Hz), ideally 165 Hz.

More specifically, FIG. 1 sets forth a front view of a therapeutic device constructed in accordance with the present invention and generally referenced by numeral 10. Therapeutic device 10 utilizes a power unit 20 having an elongated body 25. In its preferred fabrication, power unit 20 is constructed in accordance with conventional fabrication techniques and includes a drive output 21 which is moved in an oscillatory angular movement through a predetermined angular range. In the example set forth in FIG. 1, power unit 20 comprises a commercially available handheld power tool unit such as that manufactured and sold by Bosch Company having a model name Dremel Multiple Use Oscillating Tool. Suffice it to note here that power unit 20 includes a drive output 21 which, as mentioned above, is caused to move in an oscillatory angular motion through a predetermined angular range. Drive output 21 further includes a drive plate 22 and a threaded drive fastener 24. Fastener 24 is received within drive output 21 and applies pressure to drive plate 22.

Therapeutic device 10 further includes a therapeutic device head unit 11 having an elongated generally cylindrical body 14 supporting a spherical therapeutic device head 13 at one end thereof and a larger diameter generally planar therapeutic device head 12 at the opposite end. Head 12 further supports a generally planar face 16. Therapeutic device head unit 11 further includes an elongated generally planar drive arm 15 having one end secured to body 14 by a pair of conventional fasteners 17 and supporting a generally circular coupler 18 at the remaining end. Coupler 18 defines a plurality of apertures 19. Coupler 18 is received upon drive output 21 such that apertures 19 receive a plurality of indexing posts 23 formed on drive output 21. Drive plate 22 is received upon coupler 18 and is secured by fastener 24 such that coupler 18 is captivated upon drive output 21 such that indexing posts 23 are received within apertures 19.

Therapeutic device 10 further includes a vibration damping element 30 preferably formed of a resilient material such as rubber or suitable plastic material. Vibration damping element 30 is received upon the upper end of body 25 and defines an aperture 33 therein. Aperture 33 is generally aligned with drive output 21. Vibration damping element 30 further defines a pair of edges 31 and 32 which are positioned against drive arm 15. In its preferred fabrication, vibration element damping element 30 is secured to the upper portion of body 25 of power unit 20 by conventional attachment such as adhesive attachment or the like and is operative to reduce noise and vibration as the head mechanism is driven.

In operation, with power unit 20 energized and coupled to a convenient source of electrical power, power unit 20 functions to provide high speed oscillatory angular movement of drive output 21. The oscillatory angular movement of drive output 21 produces a corresponding oscillatory arcuate movement of therapeutic device head unit 11 in the manner indicated by arrows 51 and 52. In accordance with an important aspect of the present invention, the frequency of the oscillatory movement of therapeutic device head unit 11 is selected to provide shockwave vibrations in the manner described below which define the appropriate frequency for dissolving and liquefying scar tissue. Suffice it to note here that the angular oscillatory movement of therapeutic device head unit 11 reciprocates in an arcuate path through a predetermined range of angular motion having a center of motion about drive output 21.

Figure 2:
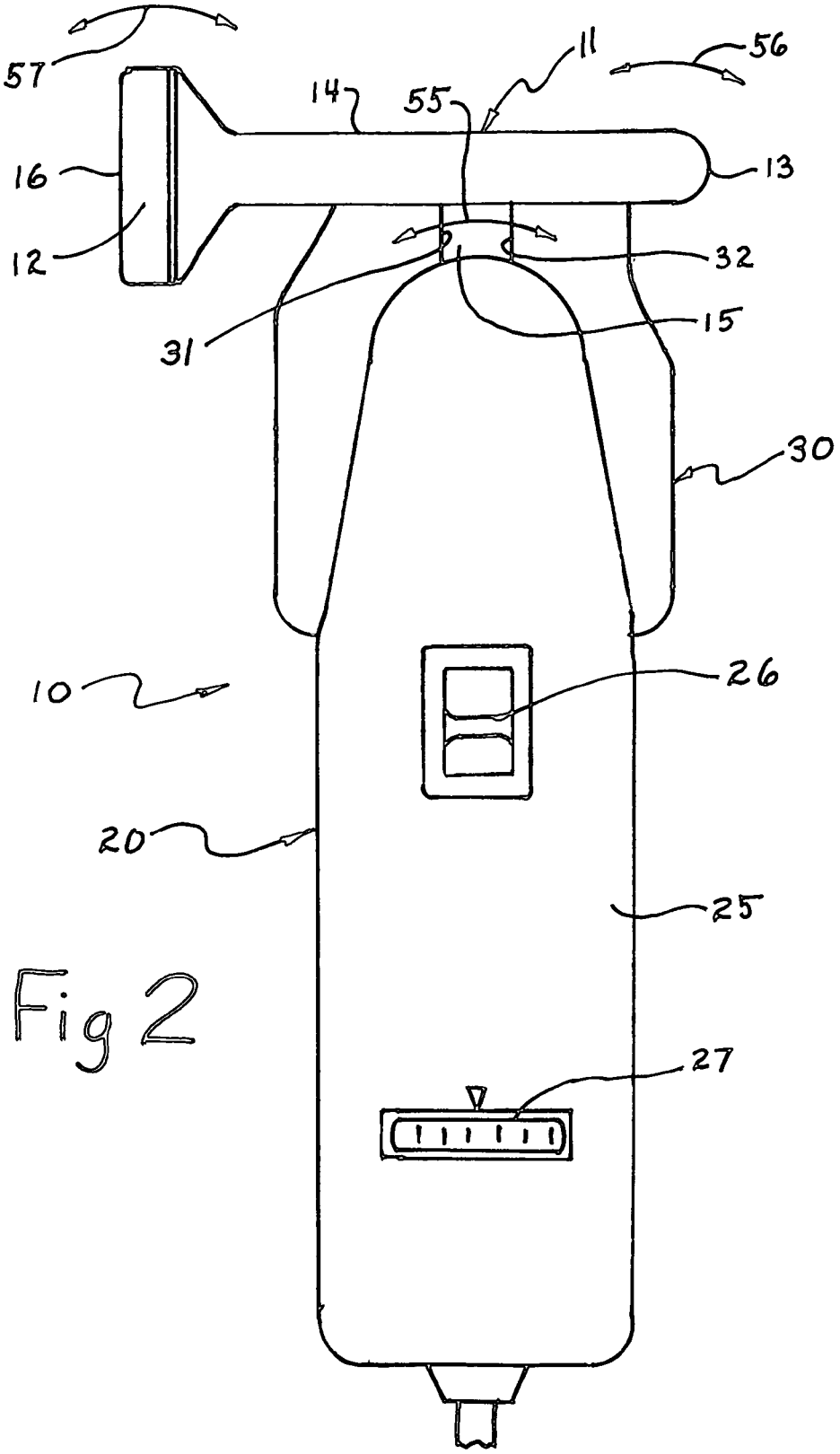
FIG. 2 sets forth a rear view of the present invention therapeutic device.

FIG. 2 sets forth a rear view of therapeutic device 10. As described above, therapeutic device 10 includes a power unit 20 having an elongated body 25 which supports therapeutic device head unit 11 in the manner also described above. A vibration damping element 30 is secured to the upper portion of elongated body 25 and defines a pair of edges 31 and 32. Therapeutic device head unit 11 includes a drive arm 15 coupled in the manner described above to the power output of power unit 10. Edges 31 and 32 of vibration damping element 30 engage the edge portions of drive arm 15 and provide vibration damping thereof. As is also described above, therapeutic device head unit 11 includes an elongated generally cylindrical body 14 defining a spherical therapeutic device head 13 and a larger diameter generally planar therapeutic device head 12. Head 12 further supports a generally planar face 16. Power unit 20 further includes an on/off switch 26 and a speed control 27. Speed control 27 facilitates the adjustment of the oscillation frequency of power unit 20.

In operation, power unit 20 is energized by the action of on/off switch 26. Once energized, power unit 20 oscillates therapeutic device head unit 11 through an arcuate motion as indicated by arrows 55. This arcuate motion in turn causes a corresponding arcuate motion for therapeutic device heads 13 and 12 in the manner indicated by arrows 56 and 57 respectively. In accordance with an important aspect of the present invention, speed control 27 is adjusted to produce oscillatory arcuate motion of therapeutic device head unit 11 at a selected frequency which has been found to be effective in liquefying and dissolving scar tissue. The use of therapeutic device 10 in practicing the present invention method is set forth below. However, suffice it to note here that once speed control 27 has been set to the predetermined frequency, therapeutic device 10 is then positioned upon the target body portion such that either of therapeutic device heads 12 or 13 are placed in skin contact.

Figure 3:
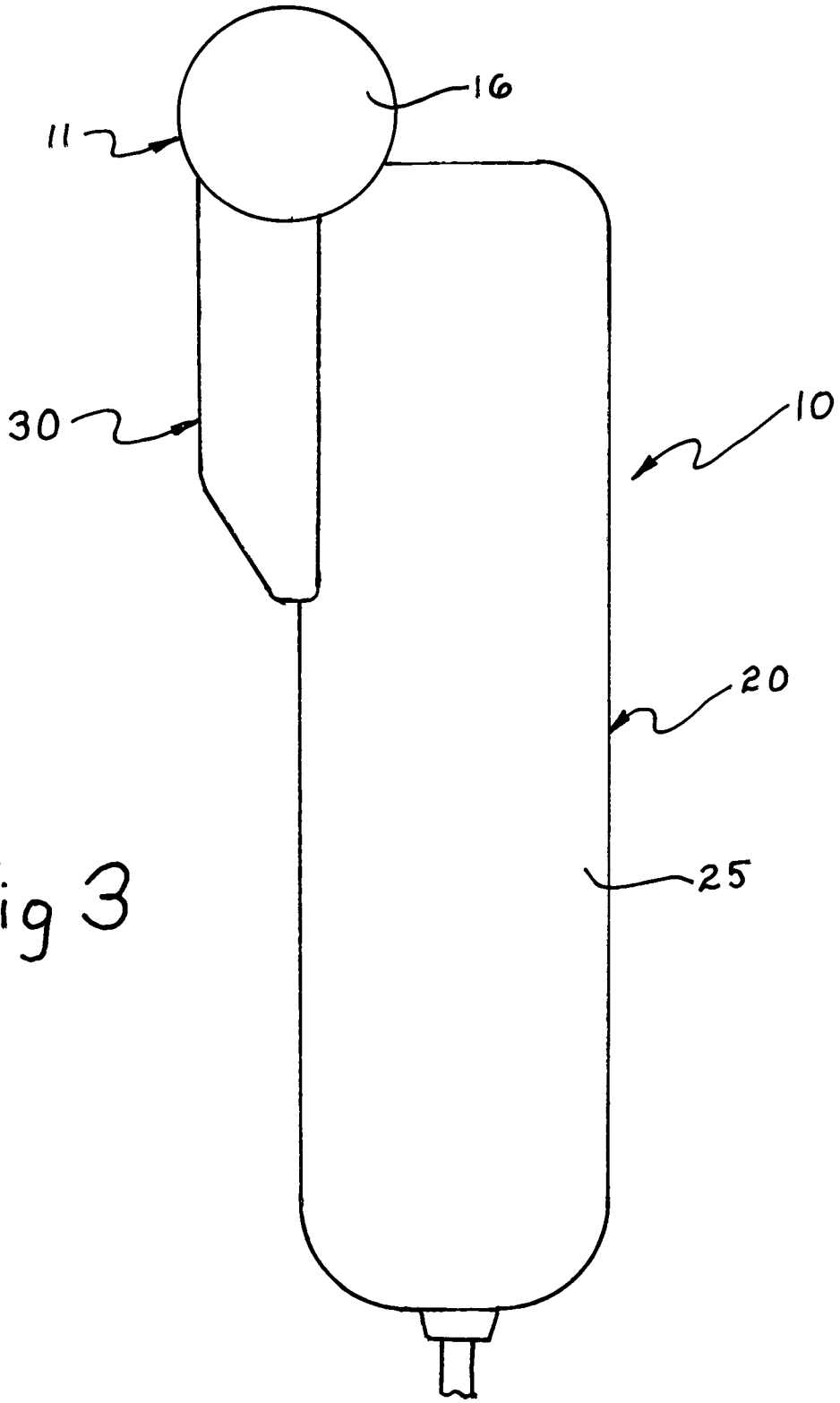
FIG. 3 sets forth a right side view of the present invention therapeutic device.

FIG. 3 sets forth a side elevation view of therapeutic device 10. As described above, therapeutic device 10 includes a power unit 20 having an elongated body 25 and supporting a vibration damping element 30. Therapeutic device 10 further includes a therapeutic device head unit 11 which further supports generally planar face 16.

Figure 4:
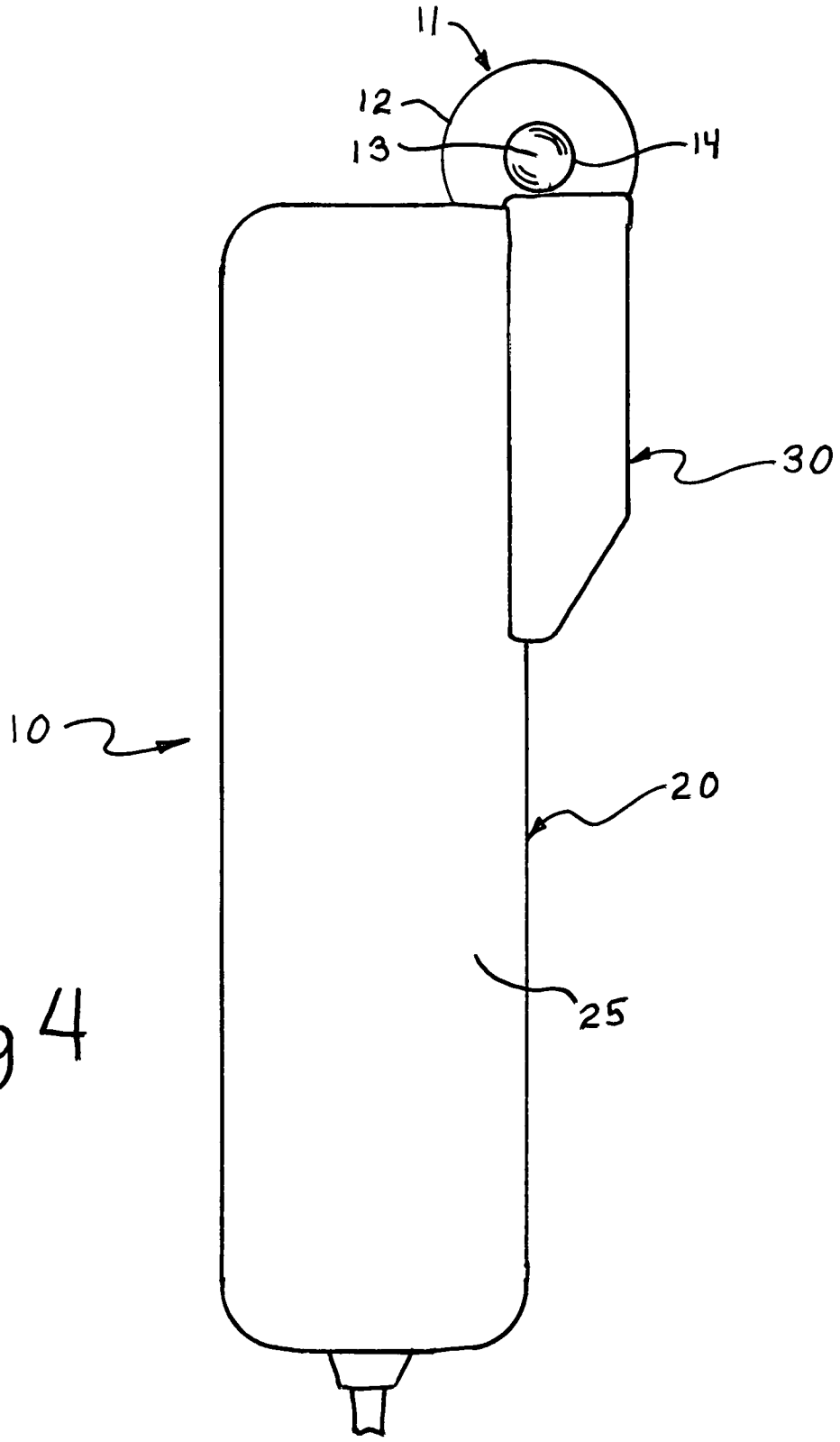
FIG. 4 sets forth a left side view of the present invention therapeutic device.

FIG. 4 sets forth a side elevation view of therapeutic device 10 showing power unit 20 having elongated body 25. Body 25 further supports vibration damping element 30 and therapeutic device head unit 11. In the view shown in FIG. 4, therapeutic device head unit 11 shows body 14, larger diameter therapeutic device head 12 and smaller diameter therapeutic device head 13.

Figure 5:
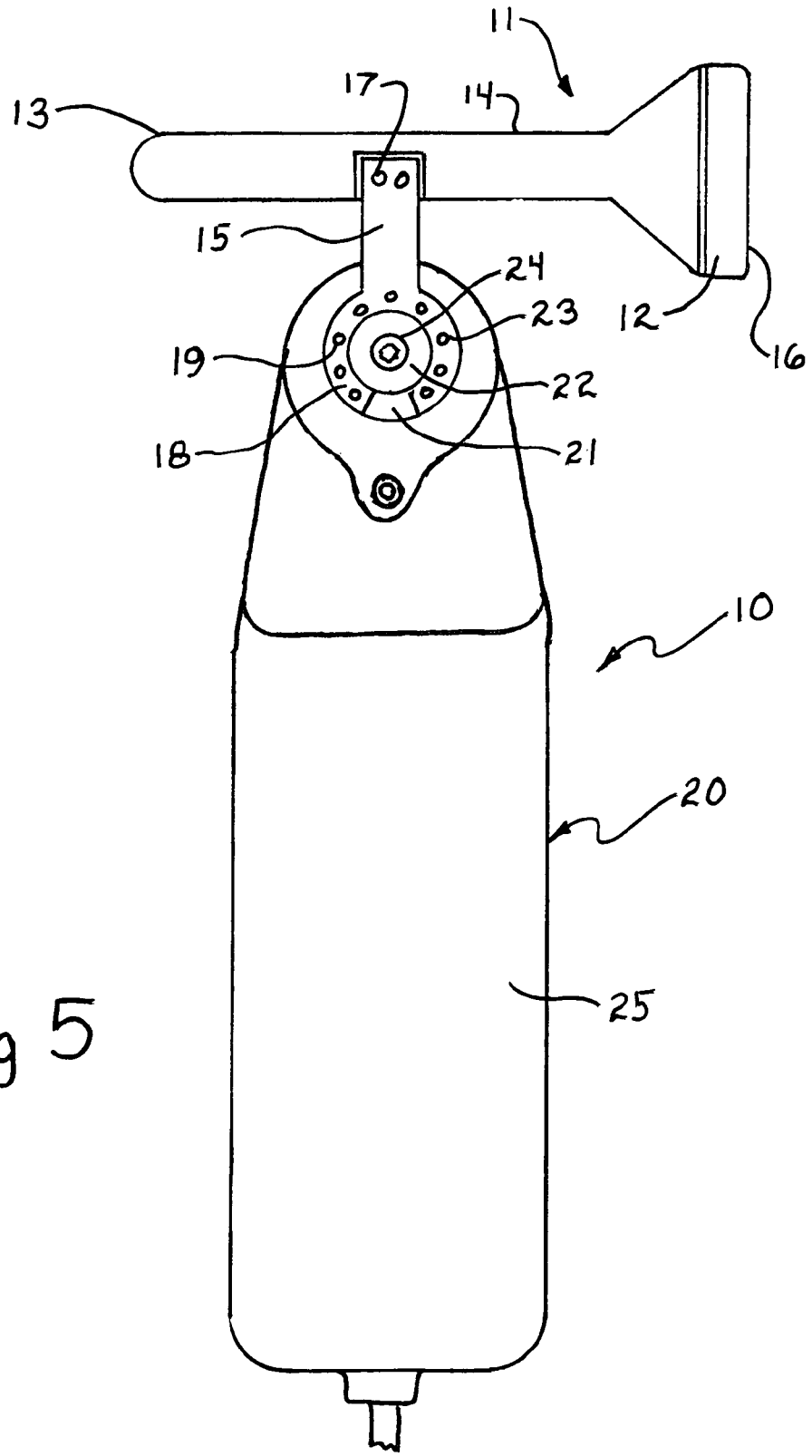
FIG. 5 sets forth a front view of the present invention therapeutic device having the vibration damping element removed.

FIG. 5 sets forth a front view of therapeutic device 10 having vibration damping element 30 removed there from. As described above, therapeutic device 10 includes a power unit 20 having an elongated body 25. Power unit 20 is, as mentioned above, fabricated in accordance with conventional fabrication techniques and may for example comprise a handheld electrically powered saw manufactured by Bosch Company under the trade name Dremel having a model Multiple Use Oscillating Tool. Power unit 20 includes a drive output 21 which is driven in an angular oscillatory movement as described above.

In further accordance with the present invention, therapeutic device 10 includes a therapeutic device head unit 11 having an elongated generally cylindrical body 14. Body 14 defines a spherical therapeutic device head 13 at one end and a generally planar therapeutic device head 12 at the remaining end. Therapeutic device head 12 supports a planar face 16. Therapeutic device head unit 11 further includes an elongated drive arm 15 secured to body 14 by a pair of conventional fasteners 17. Arm 15 further defines a generally circular coupler 18 having a plurality of apertures 19 formed therein. Correspondingly, drive output 21 supports a plurality of indexing posts 23. With coupler 18 positioned upon drive unit 21, indexing posts 23 are received within apertures 19. The position of coupler 18 is maintained by the cooperation of drive plate 22 overlying a portion of coupler 18 which in turn is maintained by a threaded fastener 24.

FIG. 6 sets forth a front view of vibration damping element 30. As described above, vibration damping 30 is preferably fabricated of a resilient elastic material such as rubber or suitably resilient plastic. Vibration damping element 30 further defines an aperture 33 and a pair of generally straight edges 31 and 32. Edges 31 and 32 extend upwardly from aperture 33 and are spaced apart to form a gap there between. With temporary reference to FIG. 1, it will be recalled that edges 31 and 32 are positioned against drive arm 15. In this manner, the movement of drive arm 15 is damped by the contact with edges 31 and 32 and energy is absorbed by the resilient material of vibration damping 30.

FIG. 7 sets forth a rear view of vibration damping element 30. Vibration element damping 30 defines an aperture 33 and a pair of spaced apart upwardly extending edges 31 and 32. Additionally, vibration damping element 30 defines a recess 34 which receives a portion of drive output 21 (seen in FIG. 1).

FIG. 8 sets forth a side view of vibration damping element 30. As mentioned above, vibration damping element 30 is preferably fabricated of a resilient material such as rubber or plastic. The angled facet of vibration damping element 30 provides clearance for handling the present invention therapeutic device at different angles.

FIG. 9 sets forth an enlarged view of therapeutic device head unit 11. In the fabrication of therapeutic device head unit 11 shown in FIG. 9, an elongated body 14 having a generally cylindrical shape defines a spherically shaped therapeutic device head 13 at one end and an enlarged generally planar therapeutic device head 12 at the opposite end. A planar face 16 is supported upon therapeutic device head 12. An elongated drive arm 15 is secured to body 14 in the attachment shown above in FIG. 1. Arm 15 terminates at its lower end in a generally circular coupler 18 defining a plurality of apertures 19 and a center aperture 29.

FIG. 10 sets forth a side view of therapeutic device head unit 11. Therapeutic device head unit 11 includes a generally cylindrical body 14 having a spherically shaped therapeutic device head 13 and a generally planar enlarged therapeutic device head 12. Therapeutic device head unit 11 further includes an elongated drive arm 15 having a coupler 18 formed thereon.

FIG. 11 sets forth an alternate embodiment of the present invention in which a therapeutic device head unit generally referenced by numeral 60 is fabricated of a one-piece molded plastic material. The function of therapeutic device head unit 60 is substantially identical to the function set forth above. Thus, it will be apparent to those skilled in the art that therapeutic device head units 11 and 60 are substantially interchangeable without departing from the spirit and scope of the present invention. Thus, therapeutic device head unit 60 includes an elongated cylindrical body 61 having a spherically shaped therapeutic device head 62 formed at one end thereof. An enlarged diameter therapeutic device head 63 having a generally planar face is formed on the opposite end of body 61. An elongated drive arm 64 extends downwardly from and is integrally formed with body 61. A generally circular coupler 65 is formed in the lower end of drive arm 64 and defines a plurality of indexing apertures 66 together with a center aperture 67.

FIG. 12 sets forth the present invention therapeutic device utilized in practicing the inventive method by which a body portion may be treated to break up scar tissue. As described above, therapeutic device 10 includes a power unit 20 having an elongated body 25 and a drive output 21. As is also described above, therapeutic device 10 includes a vibration damping element 30 secured to the upper portion of power unit 20. Vibration damping unit 30 includes an aperture 33 receiving power output 21 and a pair of generally straight edges 31 and 32. In further accordance with the present invention, therapeutic device 10 includes a therapeutic device head unit 11 having an elongated body 14 supporting a pair of therapeutic device heads 12 and 13. Therapeutic device head 12 further supports a generally planar face 16. Therapeutic device head unit 11 further includes an arm 15 joined to body 14 and having a generally circular coupler 18. As described above, coupler 18 is secured to drive output 21 by a fastener 24 and a drive plate 22.

In accordance with the present invention method for scar tissue therapy, FIG. 12 shows a typical body portion 70 having a skin surface 71. Body 70 further includes a scar tissue portion 72 which is located within body 70. In addition, body 70 is shown having a scar tissue portion 75 upon skin surface 71. In accordance with the present invention therapeutic method, the operator has operated therapeutic device 10 causing therapeutic device head unit 11 to be oscillated through angular movement as indicated by arrows 35. In further accordance with the present invention method, the frequency of this oscillatory movement is selected in accordance with a prescribed frequency to break up scar tissue. Thus, as the user places either of heads 13 or 12 against skin surface 71 the present invention therapeutic method is carried forward. For purposes of illustration, FIG. 12 shows the present invention therapeutic method utilizing head 12. By way of comparison and with temporary reference to FIG. 13, there is set forth therein the practice of the present invention method utilizing therapeutic device head 13 for treatment.

Returning to FIG. 12, with therapeutic device 10 energized and with face 16 of head 12 placed against skin surface 71, the angular oscillatory movement of therapeutic device head unit 11 imparts energy to body 70 in the form of shockwaves 36. Once again, it will be emphasized that the frequency of oscillation is selected to provide shockwaves having frequencies which have been found to break up scar tissue 72. Thereafter, the user maintains the contact of face 16 against skin surface 71 imparting shockwaves 36 through body 70 which impinge scar tissue area 72. The tissue within scar tissue area 72 is broken up by the action of shockwaves 36.

FIG. 13 sets forth the present invention method of treating of scar tissue utilizing head 13 of therapeutic device head unit 11. As illustrated in FIG. 13, massage 10 has been reversed in its position such that therapeutic device head 13 now contacts skin surface 71 of body portion 70. It will be recalled that speed control 27 is set to cause therapeutic device 10 to produce oscillatory angular motion of therapeutic device head unit 11 at a predetermined frequency. Thus, with head 13 in contact with skin surface 71, shockwaves 37 are produced which travel through the tissue of body 70 and act upon scar tissue region 72. Once again, the action of shockwaves 37 upon scar tissue 72 causes the scar tissue to be broken up and thereafter dissolved by the body.

Figure 14:
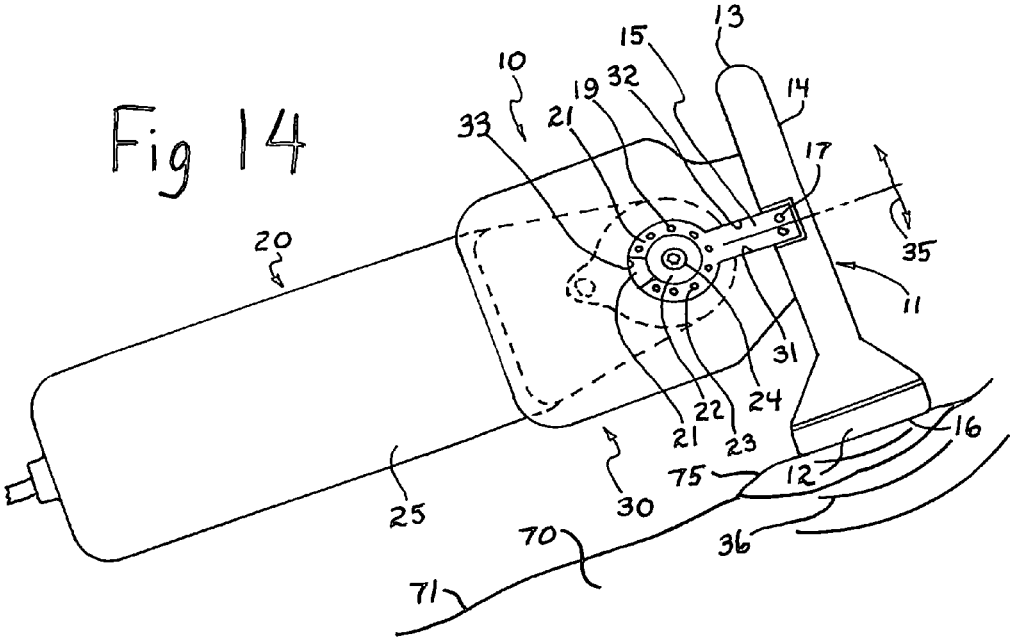
FIG. 14 sets forth a further view of the present invention therapeutic device applied to body tissue in accordance with the present invention method.
Figure 15:
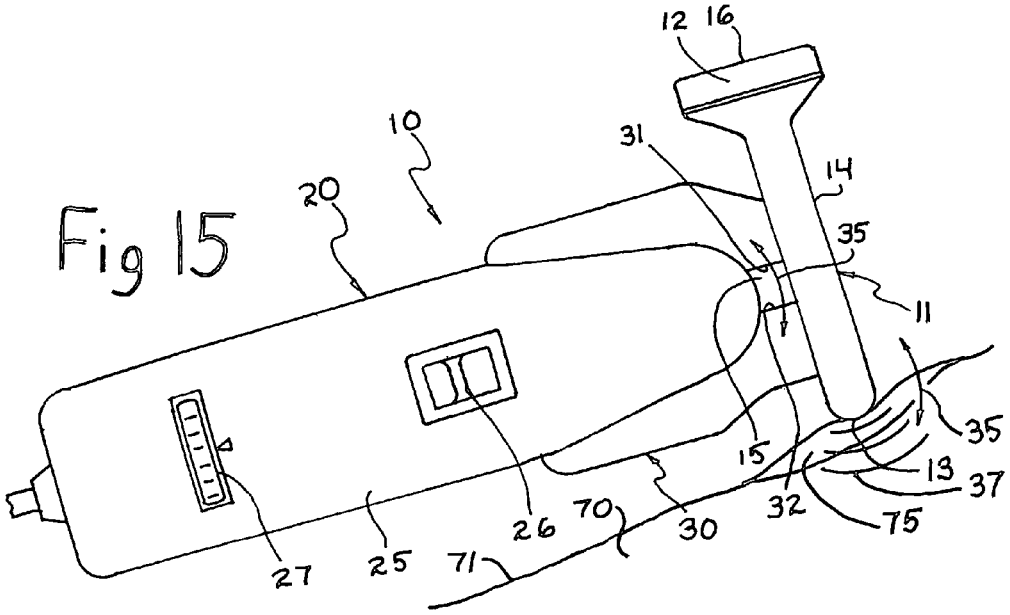
FIG. 15 sets forth a still further view of the present invention therapeutic device applied to body tissue in accordance with the present invention method.

FIGS. 14 and 15 set forth the application of the present invention method of scar tissue treatment utilizing the present invention therapeutic device applied to scar tissue which is located at and slightly below the skin surface of body 70. In FIG. 14, an area of scar tissue 75 upon and slightly below the surface of skin surface 71 is treated by placing therapeutic device head 12 of therapeutic device head unit 11 against scar tissue region 75. The oscillatory motion of therapeutic device head unit 11 in the manner indicated by arrows 35 imparts corresponding shockwaves 36 to scar tissue region 75. A portion of the shockwave energy of shockwave 36 is absorbed by scar tissue area 75 while a further portion of shockwave energy travels into body tissue 70.

FIG. 15 shows the corresponding practice of the present invention method for scar tissue treatment utilizing the present invention therapeutic device in which therapeutic device head 13 is positioned upon scar tissue area 75. Once again, the oscillatory angular movement of therapeutic device head 11 in the manner indicated by arrows 35 causes shockwaves 37 to be formed within scar tissue 75 and an underlying portion of body tissue 70.

Figure 16:
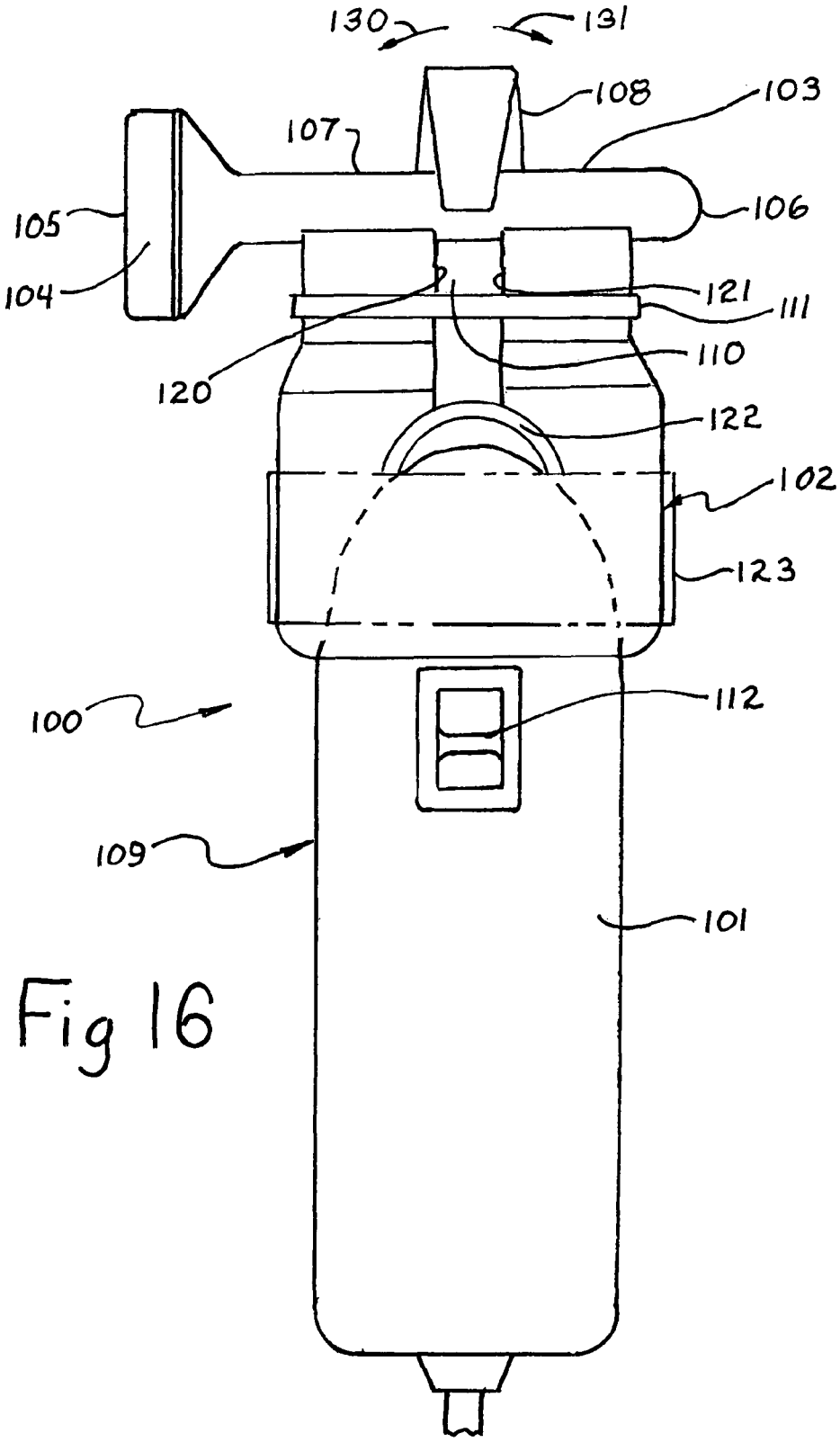
FIG. 16 sets forth a top view of an alternate embodiment of the present invention therapeutic device.

FIG. 16 sets forth a top view of an alternate embodiment of the present invention therapeutic device generally referenced by numeral 100. Therapeutic device 100 is substantially similar to therapeutic device 10 set forth above in FIGS. 1 through 15 with the differences being found in the structure of the therapeutic device head unit which provides an intermediate therapeutic head and certain changes to the vibration and noise damper element. In most other respects, however, the alternate embodiment set forth in FIGS. 16 through 19 is operative in the same manner as the embodiment set forth in FIGS. 1 through 15. In addition, the alternate embodiment set forth in FIGS. 16 through 19 will be understood to utilize a similar, if not identical, power unit to that set forth above.

More specifically, FIG. 16 sets forth a top view of a therapeutic device generally referenced by numeral 100 having a power unit 109 which in turn includes a body 101 on/off switch 112. Power unit 109 further includes a power coupler 122 which is operatively coupled to a drive arm 110. Arm 110 extends upwardly from power coupler 122 and engages and supports a therapeutic device head unit 103. Head unit 103 is substantially similar in many respects to head unit 11 set forth above in FIG. 1 with the operative difference being found in the presence of an intermediate therapeutic head 108. Thus, therapeutic head unit 103 includes an elongated generally cylindrical body 107 terminating in a semi-spherical head 106 at one end. In accordance with the alternate embodiment of FIG. 16, an intermediate head 108 is supported in the manner illustrated in FIG. 17 at the approximate midpoint of body 107 in general alignment with drive arm 110. Head unit 108 is preferably formed of a resilient elastic, plastic or rubber material having sufficient firmness to couple energy to the patient area while being sufficiently soft and resilient to provide comfort and effective massage and therapy.

Therapeutic device 100 further includes a damper 102 preferably formed of a resilient elastic material such as foam, plastic or rubber having sufficient resilience to provide damping of vibration and noise produce by power unit 109. The structure of damper 102 is set forth below in FIGS. 19A through 19E in greater detail. However, suffice it to note here that in a similar fashion to the above-described embodiment, damper 102 is received upon body 101 of power unit 109. Damper 102 defines a slot 137 having edges 120 and 121 visible in FIG. 16. With temporary reference to FIG. 19A, it will also be noted that damper 102 further defines a transverse slot 138. It will also be noted that because slot 138 interrupts the center portion of slot 137, an additional portion of opposed edges 124 and 125 are also defined in slot 137.

Returning to FIG. 16, damper 102 is received upon the upper portion of power unit 109 and is configured to received the upper portion of body 101 thereof. The elastic character of damper 102 facilitates a tight fit of damper 102 upon body 101 of power unit 109. Additionally, a supporting band 123 is tightly received upon damper 102 and encircles damper 102 and the upper portion of power unit 101 in a complete encirclement. In its preferred form, band 123 comprises a relatively strong material such as a conventional heat shrink cuff or, alternatively, may be fabricated using multiple wraps of a significantly strong adhesive tape. In either event, the function of band 123 is to complete the attachment of damper 102 upon power unit 109.

A second band 111 is received upon the upper portion of damper 102 and further facilitates the secure attachment of damper 102. Therapeutic device 100 further includes a power coupler 122 and a drive arm 110. Drive arm 110 is substantially identical to drive arm 15 set forth above in the embodiment of FIG. 1 and may be secured to body 107 of therapeutic device head unit 103 utilizing a similar attachment. Alternatively, the outer end of drive arm 110 may be secured to body 107 utilizing a welded attachment or the like. With temporary reference to FIG. 19A, it will be noted that drive arm 110 is received within transverse slot 138. Thus, drive arm 110 is resiliently captivated within damper 102.

In operation, power unit 109 oscillates therapeutic device head unit 103 in an arcuate path indicated by arrows 130 and 131 in the same fashion as described above in therapeutic device 10. Thus, therapy may be undertaken utilizing head 106 in the same fashion as described and with the same benefits and therapy as is also described above. Additionally and in accordance with a further advantage of the alternate embodiment of FIG. 16, intermediate head 108 facilitates a further therapeutic head which imparts an alternative head movement to facilitate a further variation of the therapeutic process available.

Figure 17:
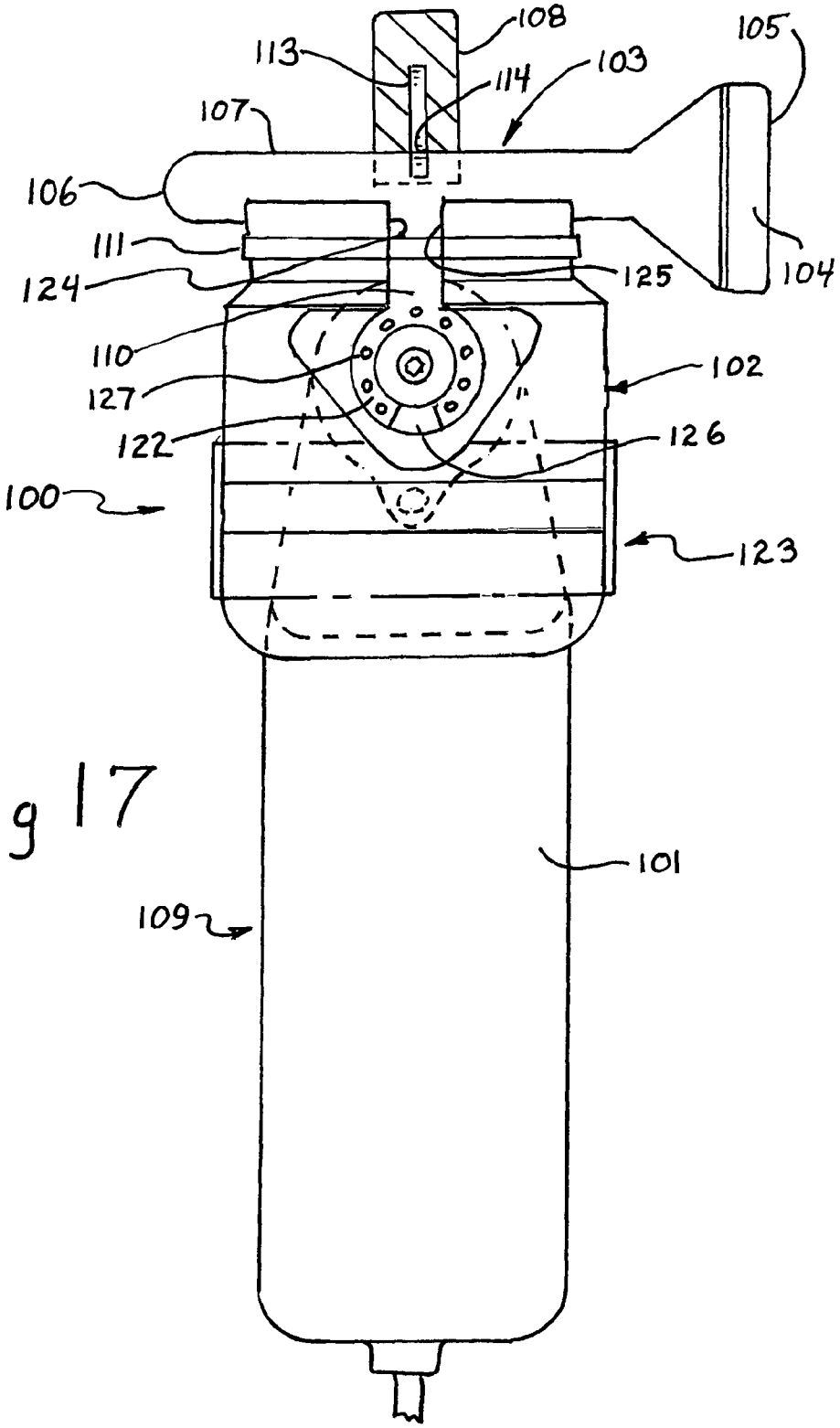
FIG. 17 sets forth a bottom view of the alternate embodiment of FIG. 16.

FIG. 17 sets forth a bottom view of therapeutic device 100 which, as described above, includes a power unit 109 having a body 101 and supporting a damper 102. As is also described above, damper 102 is secured to power unit 109 utilizing bands 123 and 111. Power unit 109 includes a drive output 126 which is operatively coupled to a coupler 122 which in turn supports drive arm 110. Drive arm 110 further supports therapeutic device head unit 103. As mentioned above, drive arm 110 passes through slot 137 of damper 102 and is received within transverse slot 138 (seen in FIG. 19A). Therapeutic head unit 103 supports heads 104 and 106 at opposite ends thereof together with a face 105. Body 107 of therapeutic device head unit 103 further includes a transversely extending flange 113. Flange 113 is substantially perpendicular to the elongation axis of body 107 and is secured by conventional fabrication such as welding or the like.

Therapeutic device 100 further includes an intermediate head 108 defining a slot 114 therein. Head 108 is shaped to conform to body 107 and is secured by a conventional adhesive attachment or similar conventional forms of attachment.

Figure 18:
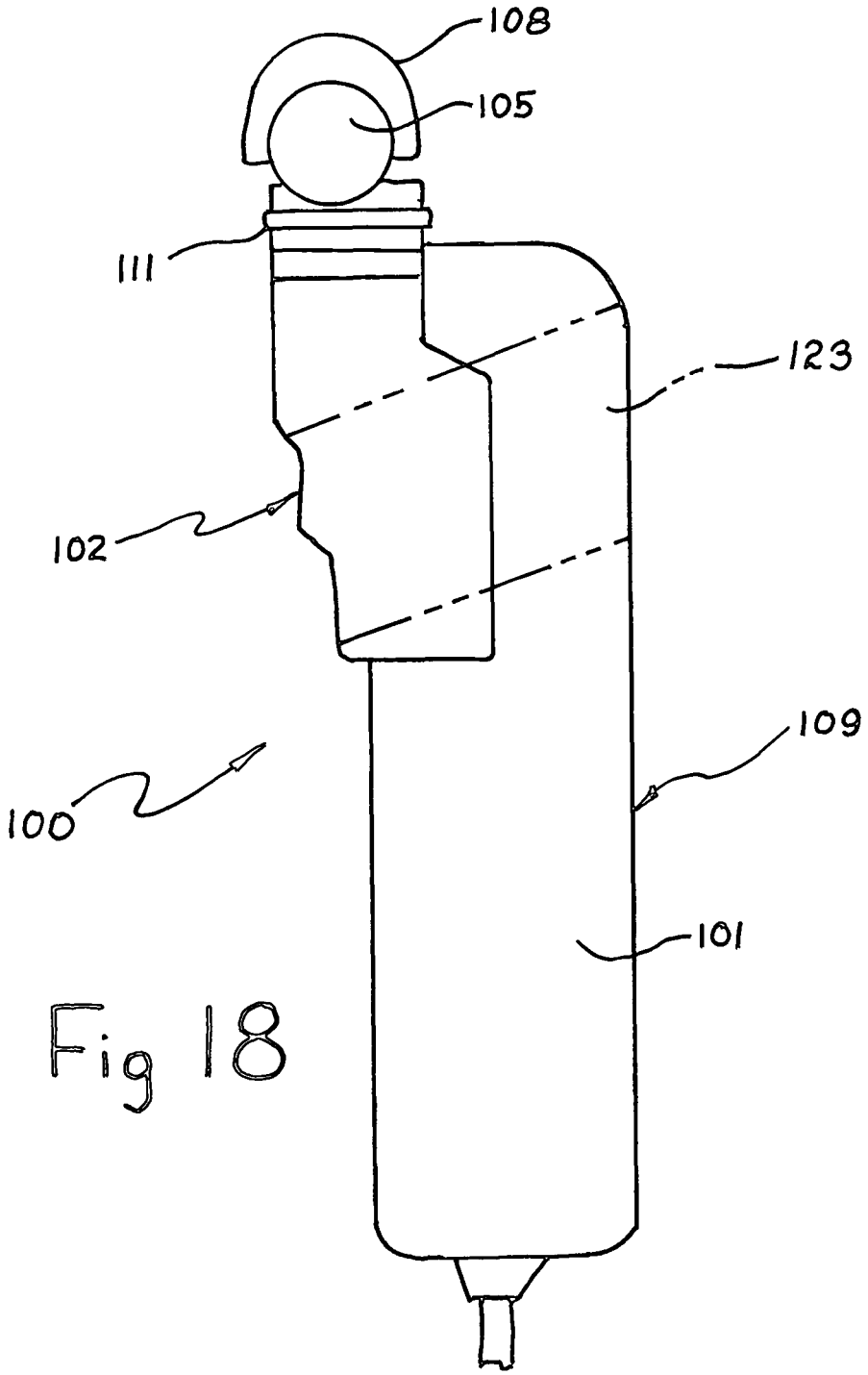
FIG. 18 sets forth a side elevation view of the alternate embodiment of FIG. 16.

FIG. 18 sets forth a side elevation view of therapeutic device 100. As described above, device 100 includes a power unit 109 having a body 101 upon which a damper 102 is secured. Damper 102 is maintained in place by a band 123 which is shown in phantom-line depiction in FIG. 18. Damper 102 further supports a band 111. Therapeutic device 100 includes a face 105 and an intermediate head 108 described above.

Figure 19C:
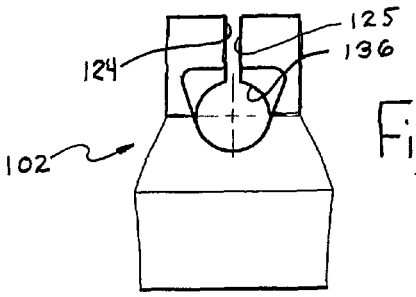
FIGS. 19A through 19E set forth respective front, rear, top, bottom and side views of the vibration damper utilized in the alternate embodiment of FIG. 16.
Figure 19A:
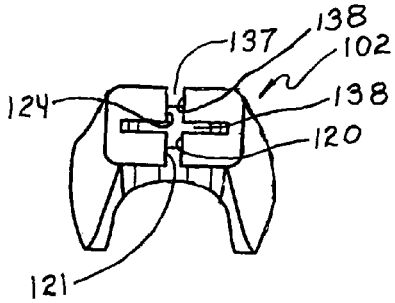
Figure 19B:
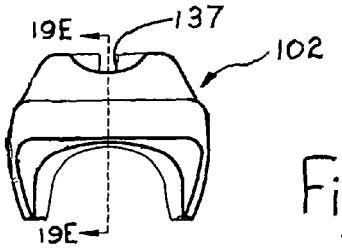
Figure 19D:
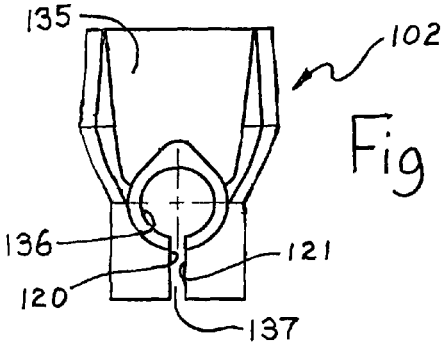
Figure 19E:
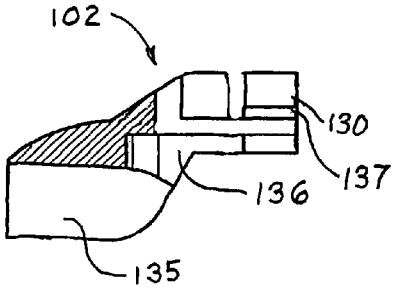

FIGS. 19A through 19E set forth respective front, rear, top, bottom and side elevation views of damper 102. Side elevation view 19E comprises a section view taken along section lines 19E shown in FIG. 19B. With simultaneous reference to FIGS. 19A through 19E, vibration damper 102 comprises a one piece resilient body formed of a resilient foam, rubber or plastic or other similar material sufficient in strength and resilience to provide vibration and noise reduction when tightly coupled to power unit 100 (seen in FIG. 16). Damper 102 defines a cavity 135 which receives the upper portion of power unit 109. Damper 102 further defines an aperture 136 which receives power coupler 122 (seen in FIG. 16). As is best seen in FIG. 19A, damper 102 further defines a slot 137 and a transverse slot 138. Slot 137 further defines edges 120 and 121 on one side of slot 138 and edges 124 and 125 on the other side of slot 138. It will be apparent to those skilled in the art that a variety of different materials may be utilized in fabricating damper 102 without departing from the spirit and scope of the present invention.

Figure 20:
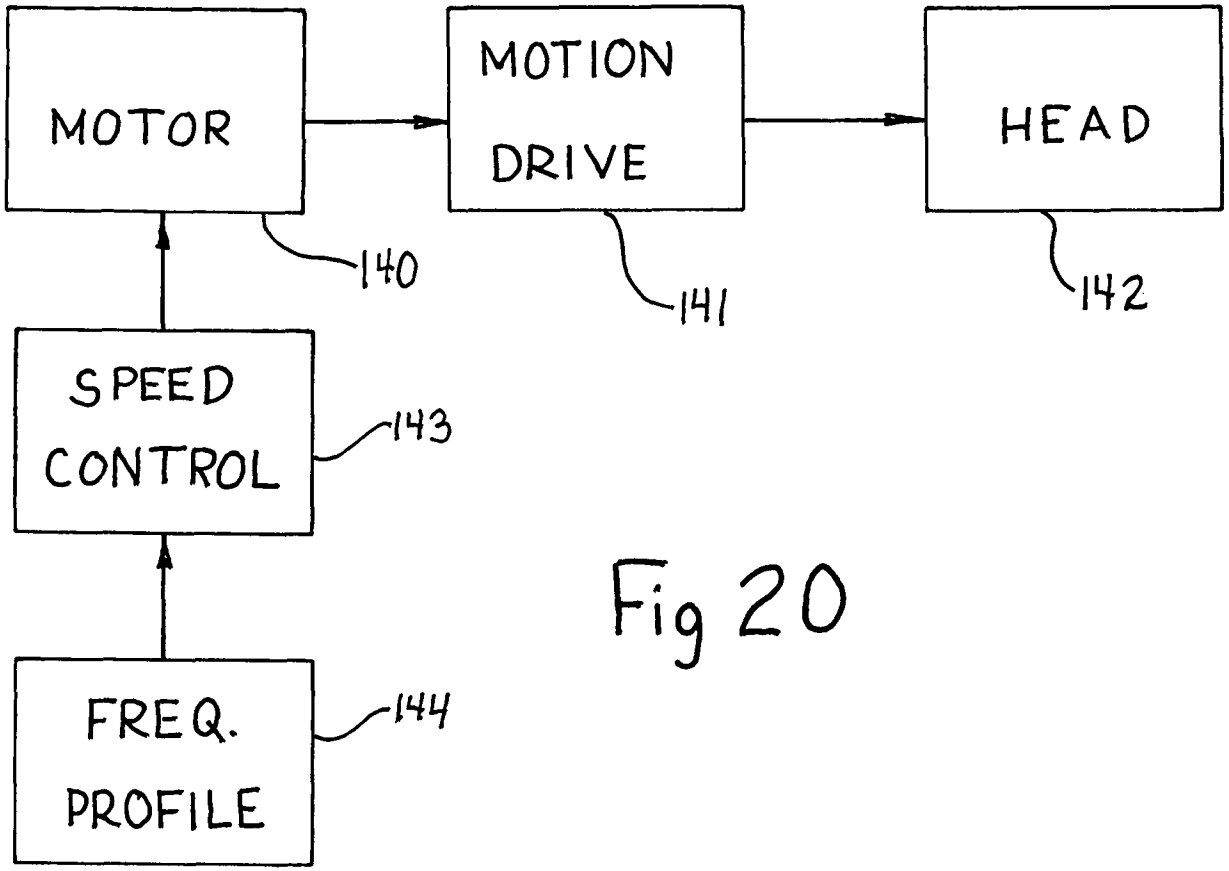
FIG. 20 sets forth a block diagram of the present invention therapeutic device operating system.

FIG. 20 sets forth an operational block diagram of the present invention therapeutic device. The operative diagram set forth in FIG. 20 generalizes the head drive and motor control apparatus of the present invention. It will be recognized by those skilled in the art that the basic block elements set forth within the operative system of FIG. 20 are readily available as conventional system components. An electric motor 140 which may for example comprise a conventional variable speed alternating current or direct current apparatus is coupled to a motion drive mechanism 141. Examples of the motion drive apparatus which may be used in the present invention therapeutic device are set forth above in FIGS. 1 through 5 and below in FIGS. 21 and 22. Suffice it to note here that motion drive mechanism 141 is operatively coupled to the rotational power output provided by motor 140. Motion drive mechanism 141 is further coupled to therapeutic head 142. The relationship between motion drive mechanism 141 and therapeutic head 142 is set forth above in great detail. Suffice it to note that the examples set forth above and accompanying descriptive material set forth the operational relationship between motion drive mechanism 141 and head 142 whereby head 142 is moved through a predetermined motion profile such as an arcuate motion to impart energy waves to the body tissue under treatment. As will be described below in greater detail, the motion profile and frequency of motion utilized in driving head 142 is the subject of some variation and flexibility to meet varying therapeutic needs. A speed control 143 constructed in accordance with conventional fabrication techniques is operatively coupled to motor 140 to vary the rotational speed of motor 140. In many conventional devices such as the device utilized in the embodiment of FIG. 2 sets forth above, a manual speed control input is provided to the device drive motor. In accordance with the speed variation utilized in the present invention apparatus, speed control 143 provides a signal control input to motor 140 rather than a manually operated control such as that set forth above in FIG. 2. A frequency profile device 144 includes a conventional processor and memory for providing a frequency profile signal coupled to speed control 143 which in turn causes speed control 143 to vary the rotational speed of motor 140 in accordance with a desired frequency variation profile. For example, frequency profile 144 may comprise a "saw" profile in which the frequency signal is increased over a predetermined time followed by a decrease over a different period of time in a repeated cyclic fashion. This causes speed control 143 to vary the rotational speed of motor 140 in an increasing rate for a period of time followed by a decreasing rate over a cyclic interval. In this manner, the frequency of movement of head 142 is caused to vary through a corresponding frequency of motion which in turn varies the frequency of energy waves imparted to the body tissue being treated.

In accordance with the preferred fabrication of the present invention and as is described above, the present invention therapeutic device enjoys great advantage and effectiveness in breaking up and "melting" and dissolving scar tissue. In this preferred fabrication and in this advantageous application of the present invention therapeutic device, it has been found that utilizing an operating frequency of therapeutic head motion which creates energy waves at or near the natural or resonant frequency of the scar tissue structure being treated provides optimum performance. In this environment, it is anticipated that frequency variation will not be required. Additionally, the present invention structure is preferably operated at an optimum motion stroke of the therapeutic head to provide the amplitude and intensity of wave energy which best treats the scar tissue.

In addition to the advantageous utilization of the present invention therapeutic device for treating various scar tissue structures within the body, it has been found that the present invention therapeutic device is also effective and advantageous in treating a variety of injuries and maladies within the body tissues. Thus, as set forth above, the present invention device may be utilized in treating various conditions such as tissue inflammation, carpal tunnel syndrome, tendonosis, muscle spasms, trapped nerves, motion range limitations, contractures, neuromas, adhesions, knee problems, tennis elbow, headaches, TMJ, and gout as well as back, shoulder and ankle pain.

In pursuing the alternative treatment capabilities of the present invention device, the flexibility of operation set forth in the operating system of FIG. 20 is employed. Accordingly, it has been found advantageous in certain treatment situations to provide movement of the therapeutic head in which the frequency is varied over a predetermined range in a cyclic fashion. In addition, the degree of therapeutic head movement (the stroke) utilized in these various therapeutic situations has also been found to respond well if a variable stroke for the therapeutic head is employed. The selection of the frequency range of therapeutic head movement and the amplitude of head stroke for a given therapeutic need provides great flexibility of use for the present invention therapeutic device.

Illustrative Case Study

As mentioned above, the present invention therapeutic device and method targets scar tissue under treatment with compression waves at a frequency preferably resonant with the resonant frequency of the scar tissue structure. The following illustrative case study describes the improvements in reduced pain and increased range of motion in a study subject initially complaining of severe right shoulder pain despite fourteen months of conventional physical therapy for a malady generally described in the art as a "Slap Tear Type 2".

Case Study Subject

The study subject is a thirty-seven year old, very athletic, right-handed male who was advised by his orthopedic surgeon and physical therapist that he had reached maximum medical improvement due to limitations imposed by post operative scar tissue buildup. He was further advised that he would no longer be able to perform his previous job duties as a sports field maintenance specialist and would be permanently disabled. The subject described his pain as a constant "five" on a scale of ten that increased to "eight" on a scale of ten with shoulder movements or during sleep on his right side. The subject's shoulder ranges of motion were approximately half of the normal ranges and movement produced severe pain.

Under treatment utilizing the present invention therapeutic device and method, an initial five minute session was applied to the soft tissue of the entire shoulder area including the pectoral, trapezium and scapular regions. In response to the initial therapy, all ranges of motion increased to approximately ninety percent of normal ranges of motion and the subject reported virtually no pain at rest and the pain levels "two out of a scale of ten" with shoulder movement. The next treatment utilizing the present invention therapeutic device and method was applied approximately eleven months following the initial treatment and produced further improvement of all ranges of motion to ninety-five percent of normal and relief of pain reported by the subject to be at a level one out of ten during shoulder movement. The subject is now able to sleep on his injured side and has returned to previous job duties with no physical limitations.

Study Conclusions

In a subject with severe shoulder pain and very limited range of motion due to extensive scar tissue structure, a fast and painless application of the present invention therapeutic device and method provides both short-term and long-term improvements in ranges of motion and pain mitigation together with improvements in overall quality of life without any additional standard medical treatment or therapy.

What has been shown is a novel and inventive therapeutic device and method which is particularly useful and effective in scar tissue therapy. In one embodiment, the devices utilizes a conventional power drive unit of the type typically used by handheld saws. In this embodiment, the present invention therapeutic device replaces the saw blade portion of the handheld power saw or other oscillating power tool with a therapeutic device head unit having an elongated generally cylindrical body defining a spherical smaller diameter head at one end and a larger diameter generally planar head at the remaining end. In an alternate embodiment, the head unit further includes an intermediate head. The elongated body is coupled to the oscillatory output of the power unit such that arcuate oscillatory movement is imparted to the therapeutic device head unit when the power unit is activated. The speed of oscillation is selected in accordance with the present invention to provide the desired frequency for therapy. For scar tissue therapy, a frequency range of 140 to 200 hertz is chosen with 170 hertz being optimum. The inventive therapeutic device is effective for the fast relief of acute and chronic conditions such as tissue inflammation, carpal tunnel syndrome, tendonosis, muscle spasms, trapped nerves, motion range limitations, contractures, neuromas, adhesions, knee problems, tennis elbow, headaches, TMJ, and gout as well as back, shoulder and ankle pain.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A therapeutic device for treating a target body tissue structure having a resonant frequency, said therapeutic device comprising:

a power unit having a drive output providing oscillatory angular movement through a predetermined angular range;

a therapeutic head unit having first, second and third therapeutic heads, a drive arm and a drive coupler, said drive coupler coupling said drive arm to said drive output, said drive arm moving said therapeutic head unit and said therapeutic head in oscillatory arcuate motion; and a vibration damper supported upon said power unit, said power unit and said drive output operative to move said drive coupler, said drive arm and said first therapeutic head in oscillatory arcuate motion such that said first, said second or said third therapeutic heads when placed against a body imparts wave energy into the tissue structure of said body having a frequency substantially equal to the resonant frequency of the target body tissue structure, said head unit including an elongated body having opposed ends, said body joined to said drive arm in a generally perpendicular relationship and wherein said first and second therapeutic heads are supported at said opposed ends, said first therapeutic head defining a generally hemispherical surface and said second therapeutic head defining a generally planar surface, said third therapeutic head being supported upon said body intermediate said opposed ends, and said third therapeutic head including a generally planar flange extending generally perpendicular from said body.

2. The therapeutic device set forth in claim 1 wherein said third therapeutic head includes a resilient flange cover.

3. The therapeutic device set forth in claim 2 wherein said power unit includes speed control means for causing said drive coupler to reciprocate said head unit at a frequency substantially equal to the resonant frequency of the target tissue structure.

* * * * *